US008547029B2

(12) United States Patent
Kumar et al.

(10) Patent No.: US 8,547,029 B2
(45) Date of Patent: Oct. 1, 2013

(54) DIMMABLE INSTANT START BALLAST

(75) Inventors: Nitin Kumar, Burlington, MA (US); Shashank Bakre, Woburn, MA (US); Driss Baba, Swampscott, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 128 days.

(21) Appl. No.: 13/352,429

(22) Filed: Jan. 18, 2012

(65) Prior Publication Data

US 2013/0181627 A1 Jul. 18, 2013

(51) Int. Cl.
*H05B 37/00* (2006.01)

(52) U.S. Cl.
USPC ..... 315/201; 315/209 R; 315/291; 315/307

(58) Field of Classification Search
USPC ..... 315/200 R, 201, 205–206, 209 R, 315/232, 239, 240, 241 R, 291, 294–295, 315/307
See application file for complete search history.

(56) References Cited

U.S. PATENT DOCUMENTS

| | | | | |
|---|---|---|---|---|
| 7,420,333 | B1 | 9/2008 | Hamdad et al. | |
| 7,952,297 | B2 * | 5/2011 | Fukui et al. | 315/247 |
| 8,212,491 | B2 * | 7/2012 | Kost et al. | 315/247 |
| 8,378,589 | B2 * | 2/2013 | Kuo et al. | 315/291 |
| 8,400,079 | B2 * | 3/2013 | Kanamori et al. | 315/307 |
| 8,456,109 | B1 * | 6/2013 | Wray | 315/307 |
| 2009/0302775 | A1 | 12/2009 | Alexandrov | |
| 2010/0134023 | A1 | 6/2010 | Mills | |
| 2010/0213850 | A1 | 8/2010 | Nerone | |
| 2013/0020964 | A1 * | 1/2013 | Nuhfer et al. | 315/291 |

OTHER PUBLICATIONS

Julian Brown, International Search Report and Written Opinion of the International Searching Authority for PCT/US2013/020879, May 3, 2013, pp. 1-7, European Patent Office, Rijswijk, The Netherlands.

* cited by examiner

*Primary Examiner* — James H Cho
(74) *Attorney, Agent, or Firm* — Shaun P. Montana

(57) ABSTRACT

A ballast for dimming a lamp is provided. The ballast includes an inverter circuit for providing a lamp current for energizing the lamp and a dim interface for receiving an input indicative of a selected lighting level. A control circuit is connected to the dim interface for generating a pulse-width-modulated signal having a duty cycle corresponding to the selected lighting level. A switching network is connected to the control circuit for receiving the pulse-width-modulated signal. The switching network operates between a conductive state and a non-conductive state as a function of the pulse-width-modulated signal. An impedance device is connected across the switching network and is configured for connecting in series with the lamp so that the impedance device receives the lamp current when the switching network is operating in the non-conductive state and the lamp current bypasses the capacitor when the switching network is operating in the conductive state.

18 Claims, 2 Drawing Sheets

DIMMABLE INSTANT START BALLAST

TECHNICAL FIELD

The present invention relates to lighting, and more specifically, to electronic ballasts for lighting.

BACKGROUND

A ballast converts alternating current (AC) power from an AC power supply so that it is suitable for energizing a lamp connected to the ballast. A ballast may include a rectifier for generating a direct current (DC) signal from the AC power received from the AC power supply, a power factor correction circuit for correcting the DC signal generated by the rectifier, and an inverter for converting the corrected DC signal to an oscillating voltage for providing to the lamp.

A ballast provides for the dimming of a lamp, such as but not limited to a fluorescent lamp, connected to the ballast by controlling the current provided to the lamp. Specifically, the ballast may be configured to vary the operating frequency of the inverter in order to control the current provided to the lamp for achieving various lighting levels. However, the frequencies at which the inverter must operate in order to generate a range of lighting levels can cause several problems, such as but not limited to electromagnetic interference and switching losses.

SUMMARY

Embodiments of the present invention provide a dimmable ballast. The ballast is configured for connecting to an alternating current (AC) power supply, and includes a rectifier for receiving an AC voltage signal via the power supply and producing a rectified voltage signal therefrom. A power factor correction circuit receives the rectified voltage signal and provides a corrected voltage signal. An inverter circuit receives the corrected voltage signal and generates a lamp current for energizing the lamp as a function of the corrected voltage signal.

A dim interface, such as a continuous dim interface, is configured for receiving an input indicative of a selected lighting level. A control circuit is connected to the dim interface for generating a pulse-width-modulated signal having a duty cycle that corresponds to the selected lighting level. A switching network is connected to the control circuit for receiving the pulse-width-modulated signal. The switching network has a conductive state and a non-conductive state, and operates between the conductive state and the non-conductive state as a function of the pulse-width-modulated signal.

An impedance device is configured for connecting in series with the lamp, and the switching network is connected across the impedance device. Accordingly, the impedance device is connected in the path of the lamp current when the switching network is operating in the non-conductive state, and the impedance device is bypassed from the path of the lamp current when the switching network is operating in the conductive state. As such, the lamp current is reduced (e.g., minimum lamp current) when the switching network is operating in the non-conductive state, and is maintained (e.g., maximum lamp current) when the switching network is operating in conductive state. By fluctuating between the minimum lamp current and the maximum lamp current in accordance with a duty cycle, the ballast is able to dim the lamp to any light level selected from a range of light levels.

In an embodiment, there is provided a dimming ballast. The dimming ballast includes: a rectifier to receive an alternating current (AC) voltage signal and produce a rectified voltage signal therefrom; a power factor correction circuit to receive the rectified voltage signal and to provide a corrected voltage signal; an inverter circuit to receive the corrected voltage signal and to provide a lamp current to energize a lamp; a dim interface to receive an input indicative of a selected lighting level; a control circuit connected to the dim interface to generate a pulse-width-modulated signal having a duty cycle corresponding to the selected lighting level; a switching network connected to the control circuit to receive the pulse-width-modulated signal, the switching network having a conductive state and a non-conductive state, wherein the switching network operates between the conductive state and the non-conductive state as a function of the pulse-width-modulated signal; and an impedance device connected across the switching network and configured to connect in series with the lamp so that the impedance device receives the lamp current when the switching network is operating in the non-conductive state and the lamp current bypasses the impedance device when the switching network is operating in the conductive state, resulting in the dimming of the lamp to the selected lighting level.

In a related embodiment, the dim interface may be a continuous dim interface. In another related embodiment, the pulse-width-modulated signal may have a high state and a low state, wherein the switching network may operate in the non-conductive state when the pulse-width-modulated signal is in the high state, and the switching network may operate in the conductive state when the pulse-width-modulated signal is in the low state.

In yet another related embodiment, the pulse-width-modulated signal may have a high state and a low state, wherein the switching network may operate in the conductive state when the pulse-width-modulated signal is in the high state, and the switching network may operate in the non-conductive state when the pulse-width-modulated signal is in the low state.

In still another related embodiment, the switching network may include: a first metal-oxide-semiconductor field-effect transistor (MOSFET) having a gate terminal, a source terminal, and a drain terminal; and a second MOSFET having a gate terminal, a source terminal, and a drain terminal; wherein the gate terminal of the first MOSFET may be connected to a first terminal of the impedance device, and the gate terminal of the second MOSFET may be connected to a second terminal of the impedance device. In yet still another related embodiment, the inverter circuit may include a transformer, and the inverter circuit may be configured to provide the lamp current to the lamp via the transformer. In a further related embodiment, the dimming ballast may include a transformer winding to provide power to the switching network, wherein the transformer winding may be a bias winding on the transformer of the inverter circuit.

In still yet another related embodiment, the dimming ballast may be configured to energize a plurality of lamps that are connected together in parallel.

In another embodiment, there is provided a dimming ballast. The dimming ballast includes: an inverter circuit to provide a lamp current to energize a lamp; a dim interface to receive an input indicative of a selected lighting level; a control circuit connected to the dim interface to generate a pulse-width-modulated signal having a duty cycle corresponding to the selected lighting level; a switching network connected to the control circuit to receive the pulse-width-modulated signal, the switching network having a conductive state and a non-conductive state, wherein the switching network operates between the conductive state and the non-conductive state as a function of the pulse-width-modulated signal; and an impedance device connected across the switching network and configured to connect in series with the lamp so that the impedance device receives the lamp current when the switching network is operating in the non-conductive state and the lamp current bypasses the impedance device when the switching network is operating in the conductive state, resulting in the dimming of the lamp to the selected lighting level.

In a related embodiment, the dimming ballast may further include: a rectifier to receive an alternating current (AC) voltage signal and produce a rectified voltage signal therefrom; and a power factor correction circuit to receive the rectified voltage signal and to provide a corrected voltage signal, wherein the inverter may be connected to the power factor correction circuit and the inverter may be configured to generate the lamp current as a function of the corrected voltage signal. In another related embodiment, the dim interface may be a continuous dim interface. In still another related embodiment, the pulse-width-modulated signal may have a high state and a low state, wherein the switching network may operate in the non-conductive state when the pulse-width-modulated signal is in the high state, and the switching network may operate in the conductive state when the pulse-width-modulated signal is in the low state. In yet another related embodiment, the pulse-width-modulated signal may have a high state and a low state, wherein the switching network may operate in the conductive state when the pulse-width-modulated signal is in the high state, and the switching network may operate in the non-conductive state when the pulse-width-modulated signal is in the low state.

In still yet another related embodiment, the switching network may include: a first metal-oxide-semiconductor field-effect transistor (MOSFET) having a gate terminal, a source terminal, and a drain terminal; and a second MOSFET having a gate terminal, a source terminal, and a drain terminal; wherein the gate terminal of the first MOSFET may be connected to a first terminal of the impedance device and the gate terminal of the second MOSFET may be connected to a second terminal of the impedance device.

In yet still another related embodiment, the inverter circuit may include a transformer, and the inverter circuit may be configured to provide the lamp current to the lamp via the transformer. In a further related embodiment, the dimming ballast may include a transformer winding to provide power to the switching network, wherein the transformer winding may be a bias winding on the transformer of the inverter circuit.

In still yet another related embodiment, the dimming ballast may further include an isolation circuit connected between the control circuit and the switching network. In yet still another related embodiment, the dimming ballast may be configured to energize a plurality of lamps that are connected together in parallel.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
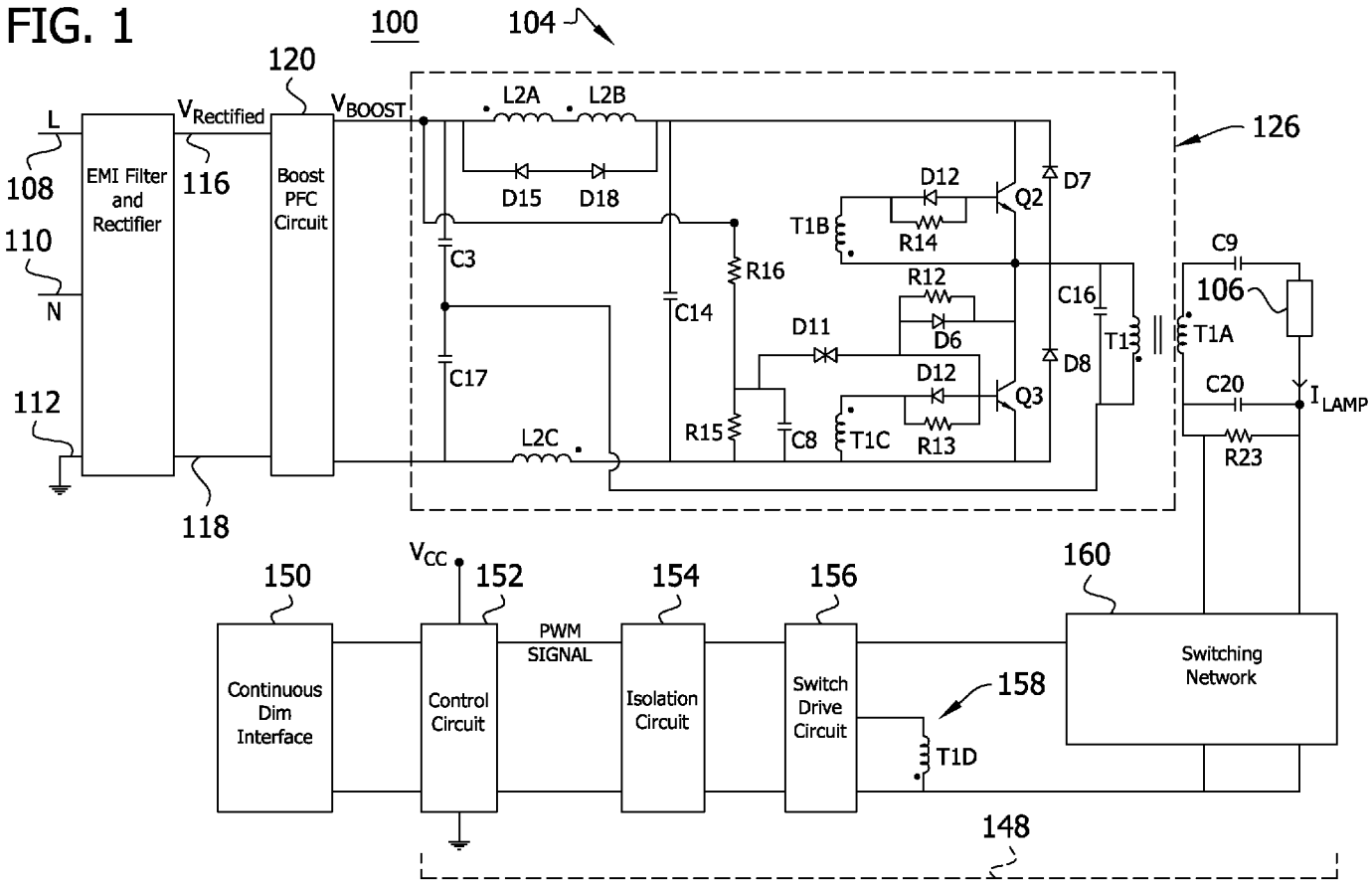
FIG. 1 is a schematic diagram, partially in block form, of a lamp system according to embodiments disclosed herein.

FIG. 1 shows a lamp system 100, including an input power source (not shown), such as an alternating current (AC) power supply, an electronic ballast 104 (hereinafter ballast 104), and a lamp 106. In some embodiments, the lamp 106 is a fluorescent lamp, such as but not limited to a 32 W T8 fluorescent lamp available from OSRAM SYLVANIA, Philips, or General Electric. However, embodiments contemplate the use of other types of lamps as well.

The ballast 104 includes at least one high voltage input terminal (i.e., line voltage input terminal) 108 adapted for connecting to the alternating current (AC) power supply (e.g., standard 120V AC household power), a neutral input terminal 110, and a ground terminal 112 connectable to ground potential. An input AC power signal is received by the ballast 104 from the AC power supply via the high voltage input terminal 108. The ballast 104 includes an electromagnetic interference (EMI) filter and a rectifier (e.g., full-wave rectifier) 114, which are illustrated together in FIG. 1. The EMI filter portion of the EMI filter and rectifier 114 prevents noise that may be generated by the ballast 104 from being transmitted back to the AC power supply 102. The rectifier portion of the EMI filter and rectifier 114 converts AC voltage received from the AC power supply 102 to direct current (DC) voltage. The rectifier portion includes a first output terminal connected to a DC bus 116 and a second output terminal connected to a ground potential at ground connection point 118. Thus, the EMI filter and rectifier 114 outputs a DC voltage ($V_{Rectified}$) on the DC bus 116.

A power factor correction circuit 120, which may, in some embodiments, be a boost converter, is connected to the first and second output terminals of the EMI filter and rectifier 114. The power factor correction circuit 120 receives the rectified DC voltage ($V_{Rectified}$) and produces a high DC voltage ($V_{Boost}$) on a high DC voltage bus ("high DC bus") 122. An inverter circuit 126 has an input connected to the power factor correction circuit 120 for receiving the high DC voltage ($V_{Boost}$) from the power factor correction circuit 120. The inverter circuit 126 is configured to convert the high DC voltage ($V_{Boost}$) from the power factor correction circuit 120 to an oscillating voltage signal for supplying to the lamp 106.

In FIG. 1, the inverter circuit 126 has a current choke circuit connected at the inverter circuit input. Capacitors C3 and C17 are electrolytic capacitors that store energy. Windings L2A, L2B, and L2C are windings of the current choke. Together the windings L2A, L2B, and L2C, capacitors C14 and C16, a transformer winding T1, and switches Q2 and Q3 form a resonant circuit used in operating the inverter circuit 126. Clamping TVS diodes D15 and D18 are connected in series across the windings L2A and L2B to clamp voltage. As generally known, the inverter circuit 126 includes a first switching component (i.e., switch) Q2 and a second switching component (i.e., switch) Q3. For example, the first and second switching components Q2 and Q3 may each comprise a bipolar junction transistor (BJT). As such, the first switching component Q2 and the second switching component Q3 each have a collector terminal, a base terminal, and an emitter terminal. The first and second switching components Q2 and Q3 complementarily operate between a non-conductive state and a conductive state in order to produce the oscillating voltage signal. A first drive circuit is formed by a transformer winding T1B, a diode D12, and a resistor R14. The first drive circuit drives the first switching component Q2. Similarly, a second drive circuit is formed by a transformer winding T1C, a diode D13, and a resistor R13. The second drive circuit drives the second switching component Q3. A diode D7 is connected across the emitter and collector terminals of the first switching component Q2, and a diode D8 is connected across the emitter and collector terminals of the second switching component Q3. A resonant capacitor C16 is connected at the emitter terminal of the second switching component Q3.

A starting circuit is connected between the base and emitter terminals of the second switching component Q3. The starting circuit includes a diode for alternating current (DIAC) D11, a resistor R15, a resistor R16 and a capacitor C8. The DIAC D11 has a predetermined breakover voltage. When voltage at an input to the DIAC D11 (i.e., a voltage across the capacitor C8) increases to the predetermined breakover voltage, the DIAC D11 switches from operating in a non-conductive mode to operating in a conductive mode. As such, the DIAC D11 conducts a startup pulse to the second switching component Q3 to initiate switching operations. In FIG. 1, the resistors R15 and R16 form a voltage divider, and once the voltage across the resistor R15 reaches the predetermined breakover voltage (e.g., 32 Volts), the DIAC D11 breaks down and the inverter circuit 126 is started.

Once the second switching component Q3 is initially turned on via the starting circuit, the inverter circuit 126 operates in a normal operating mode, wherein the first and second switching components Q2 and Q3 are complementarily commutated via the first and second drive circuits. In other words, the first and second switching components Q2 and Q3 are operated such that when the first switching component Q2 is conductive (e.g., ON), the second switching component Q3 is non-conductive (e.g., OFF). Likewise, when the second switching component Q3 is conductive (e.g., ON), the first switching component Q2 is non-conductive (e.g., OFF). The inverter circuit 126 includes a resistor R12 and a diode D6 connected in parallel between the collector terminal of the second switching component Q3 and the starting circuit to prevent the DIAC D11 from conducting during the normal operating mode. The inverter circuit 126 includes a transformer providing oscillating current to the lamp 106. In particular, a primary winding T1 of the transformer is connected in parallel with the resonant capacitor C19. A secondary winding T1A of the transformer is configured for connecting in series with the lamp 106. A current limiting capacitor C9 is also connected in series with the lamp 106, between the primary winding T1 of the transformer and the lamp 106, in order to limit the oscillating current received by the lamp 106 (hereinafter "lamp current"). In FIG. 1, the primary winding T1, the secondary winding T1A, the base drive windings T1B and TIC, and a bias winding (described below) are wound on one core, while the windings L2A, L2B, and L2C are wound on another core.

An impedance device, such as but not limited to a capacitor C20, is connected in the path of the lamp current for selectively reducing the lamp current applied to the lamp 106. An impedance control circuit 148 is connected to the impedance device (e.g., the capacitor C20) for selectively introducing and eliminating impedance into/from the path of the lamp current by selectively introducing and eliminating a short circuit bypass connected in parallel with the impedance device. When the impedance provided by the impedance device is present in the path of the lamp current, the lamp current applied to the lamp 106 is reduced, and the amount of light generated by the lamp 106 is thereby reduced. The impedance control circuit 148 introduces and eliminates the impedance into/from the path of the lamp current at a particular frequency. Thus, the lamp current applied to the lamp 106 and the amount of light generated by the lamp 106 is likewise maintained and reduced at the particular frequency. The particular frequency is fast enough that the changes in the amount of light generated by the lamp 106 are generally imperceptible to the human eye. Instead, the amount of light perceived to be generated by the lamp 106 (i.e., "light level" or "lighting level") is the average amount of light generated by the lamp 106 over a short period of time. As such, by adjusting the amount of time that the impedance device is introduced into and eliminated from the path of the lamp current, aspects of the present invention provide a dimmable ballast for enabling various light levels/lighting levels to be generated by the lamp 106.

The lamp system 100 includes a continuous dim interface 150 for receiving an input indicative of a selected lighting level and generating a dim signal indicative of the selected lighting level. For example, the continuous dim interface 150 may generate a voltage signal having a voltage value in the continuous range of 0 Volts to 10 Volts. Each voltage value in the voltage range corresponds to a lighting level. Thus, 0 Volts may correspond to 40% of light output for the lamp 106, and 10 Volts may correspond to 100% of light output for the lamp 106. As the voltage value of the voltage signal increases from 0 Volts to 10 Volts the brightness of the corresponding light level increases. Although FIGS. 1 and 2 both illustrate a continuous dim interface 150, it should be noted that another dim interface, such as a step dim interface, may be used in addition or as an alternative to the continuous dim interface 150 without departing from the scope of the invention.

The continuous dim interface 150 is connected to a control circuit 152. The continuous dim interface 150 provides the dim signal (e.g., direct current (DC) voltage signal) indicative of the selected lighting level to the control circuit 152. The control circuit 152 receives the dim signal and generates a pulse-width-modulated (PWM) signal PWM SIGNAL having a duty cycle that corresponds to the selected lighting level. A switching network 160 is connected in parallel with the impedance device (e.g., the capacitor C20). The switching network 160 has a conductive state and a non-conductive state. During the conductive state, the switching network 160 conducts current and operates substantially as a short circuit. During the non-conductive state, the switching network 160 does not conduct current and thereby operates substantially as an open circuit. Thus, when the switching network 160 operates in the conductive state, the switching network 160 operates as a short circuit that bypasses the impedance device C20 from the path of the lamp current. When the switching network 160 operates in the non-conductive state, the switching network 160 operates as an open circuit so that the impedance device C20 is maintained in the path of the lamp current.

The switching network 160 is configured to receive the PWM signal PWM SIGNAL generated by the control circuit 152, and to operate between the conductive state and the non-conductive state as a function of the received PWM signal PWM SIGNAL. In particular, as generally known, the PWM signal PWM SIGNAL has a high state and a low state. The state of the PWM signal PWM SIGNAL controls the state of the switching network 160. In some embodiments, when the PWM signal PWM SIGNAL operates in the high state, the switching network 160 operates in the non-conductive state, and when the PWM signal PWM SIGNAL operates in the low state, the switching network operates 160 in the conductive state. Thus, when the PWM signal PWM SIGNAL operates in the high state, the impedance device C20 generates impedance in the path of the lamp current and thereby reduces the lamp current applied to the lamp 106. On the other hand, when the PWM signal PWM SIGNAL operates in the low state, the impedance device C20 is bypassed from the path of the lamp current and the lamp current applied to the lamp 106 is not reduced. Accordingly, the lamp 106 generates a maximum amount of light when the PWM signal PWM SIGNAL operates in the low state because a maximum lamp current is applied to the lamp 106. Conversely, the lamp 106 generates a minimum amount of light when the PWM signal PWM SIGNAL operates in the high state because a reduced lamp current is applied to the lamp 106. Since the amount of light generated by the lamp 106 fluctuates between the maximum and the minimum at a rapid rate that is imperceptible to the human eye, the amount of perceived light (i.e., light level, lighting level) is the average amount of light generated in a particular time interval.

Alternatively, in other embodiments, when the PWM signal PWM SIGNAL operates in the high state, the switching network 160 operates in the conductive state, and when the PWM signal PWM SIGNAL operates in the low state, the switching network operates 160 in the non-conductive state. Thus, when the PWM signal PWM SIGNAL operates in the high state, the impedance device C20 is bypassed from the path of the lamp current and the lamp current applied to the lamp 106 is not reduced. On the other hand, when the PWM signal PWM SIGNAL operates in the low state, the impedance device C20 generates impedance in the path of the lamp current and thereby reduces the lamp current applied to the lamp 106. Accordingly, the lamp 106 generates a maximum amount of light when the PWM signal PWM SIGNAL operates in the high state because a maximum lamp current is applied to the lamp 106. Conversely, the lamp 106 generates a minimum amount of light when the PWM signal PWM SIGNAL operates in the low state because a reduced lamp current is applied to the lamp 106.

An isolation circuit 154 is connected to the control circuit 152 between the control circuit 152 and the switching network 160. The isolation circuit 154 is configured to isolate the control circuit 152 from the lamp 106 so that high voltages that may be generated on the lamp side of the isolation circuit 154 are prevented from damaging the control circuit 152. A switch drive circuit 156 is connected between the isolation circuit 154 and the switching network 160. The switch drive circuit 156 is configured to drive the switching network 160 in accordance with the PWM signal PWM SIGNAL. A biasing element 158 is connected to switch drive circuit 156 for providing power to the switching network. In the lamp system 100, the biasing element 158 is a secondary transformer winding 158 of the transformer T1.

In operation, the continuous dim interface 150 receives an input selecting a light level to be generated by the lamp 106. The continuous dim interface 150 generates a dim signal having a voltage value that is indicative of the selected light level and provides the dim signal to the control circuit 152. The control circuit 152 generates a PWM signal PWM SIGNAL having a duty cycle that corresponds to the selected light level. In particular, the PWM signal PWM SIGNAL has a predetermined modulation frequency. The modulation frequency is selected to be rapid enough that the changes in the amount of light driven by the PWM signal PWM SIGNAL are imperceptible to the human eye. For example, the predetermined modulation frequency may be 300 Hertz. The predetermined modulation frequency defines the length of time (i.e., period) for a single cycle of the PWM signal PWM SIGNAL. The control circuit 130 determines the duty cycle (i.e., ratio of the amount of time during a single cycle that the PWM signal PWM SIGNAL is in the high state relative to the total length of time of a single cycle) of the PWM signal so PWM SIGNAL that it is proportionate to the amount of time during the duty cycle that the lamp 106 generates the maximum lamp output.

In one example, the minimum selected light level is 40% of the lamp output and the maximum selected light level is 100% of the lamp output. Thus, the impedance device C20 is selected such that when the impedance device C20 is present in the path of the lamp current (i.e., switching network is non-conductive), the lamp current is reduced such that the lamp 106 only generates 40% of the lamp output. When the impedance device C20 is not present in the path of the lamp current (i.e., switching network is conductive), the lamp 106 generates 100% of the lamp output. Accordingly, if the selected light level is 60%, the duty cycle would be 33.33%. Thus, for a given cycle, the switching network 160 would be non-conductive for 33.33% of the time, and would be conductive for 66.67% of the time. In turn, for the given cycle, the lamp 106 would generate 100% of the lamp output for 33.33% of the time and would generate 40% of the lamp output for 66.67% of the time.

Figure 2:
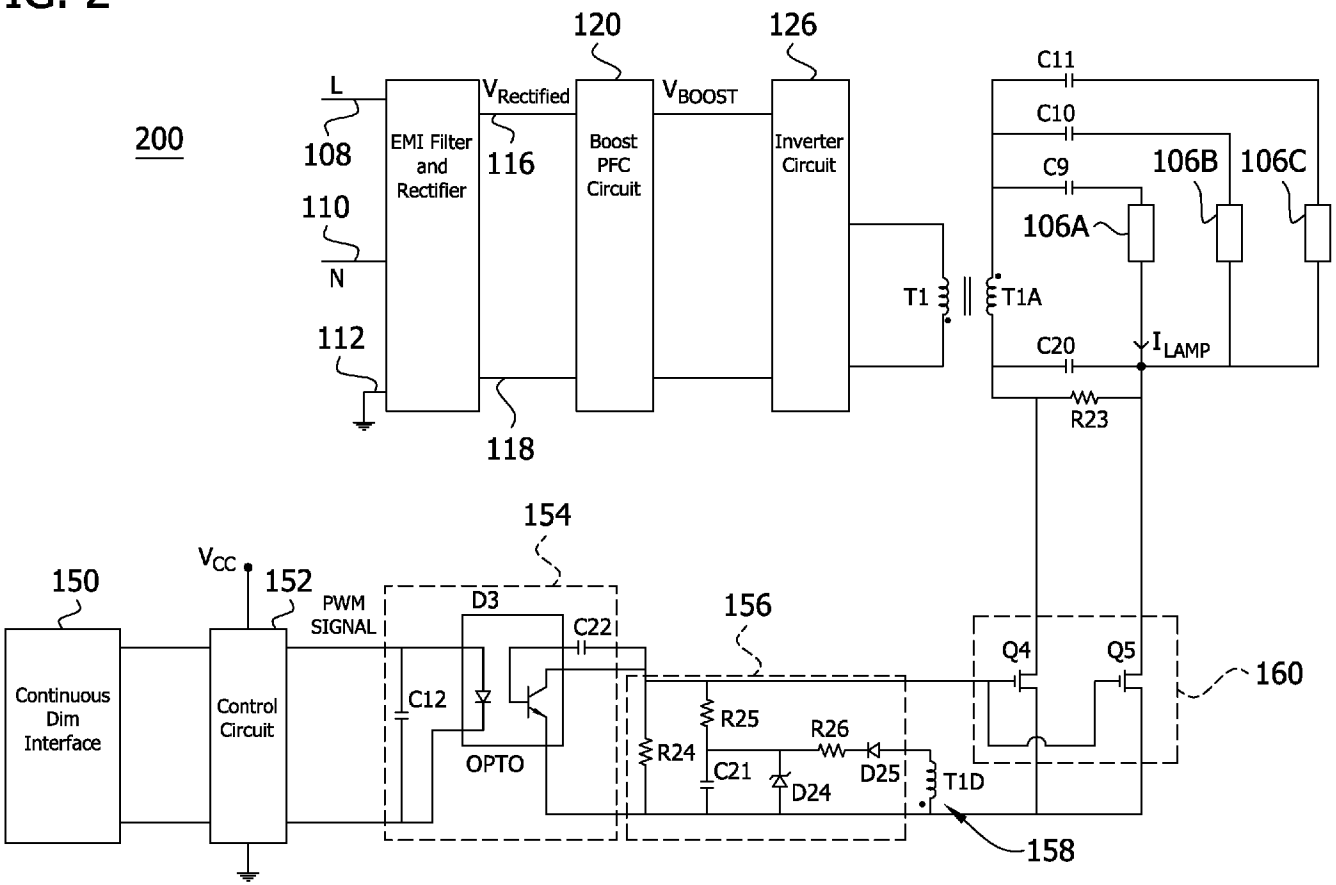
FIG. 2 is a schematic diagram, partially in block form, of a lamp system according to embodiments disclosed herein.

FIG. 2 illustrates a lamp system 200, including the general components described above in connection with the lamp system 100 of FIG. 1, and illustrates an exemplary isolation circuit 154, an exemplary switch drive circuit 156, and an exemplary switching network 160. The isolation circuit 154 of the lamp system 200 comprises an optocoupler and capacitors C12 and C22. The isolation circuit 154 transfers the PWM signal PWM SIGNAL from the control circuit 152 to a light wave and then senses energy from the light wave and converts the sensed energy back into electrical energy.

The switching network 160 comprises a first switching component Q4 and a second switching component Q5. In some embodiments, each of the first and second switching components Q4 and Q5 is a metal-oxide-semiconductor field-effect transistor (MOSFET) having a gate terminal, a source terminal, and a drain terminal. The drain terminal of the first switching component Q4 is connected to a first terminal of the impedance device C20, and the drain terminal of the second switching component Q5 is connected to a second terminal of the impedance device C20. The source terminal of the first switching component Q4 and the source terminal of the second switching component Q5 are connected together (i.e., common source). Similarly, the gate terminal of the first switching component Q4 and the gate terminal of the second switching component Q5 are connected together (i.e., common gate). The gate terminals of the first and second switching components Q4 and Q5 are connected to a switch drive 158. The switch drive 158 includes resistors R24, R25, and R26, a capacitor C21, and a diode D25 configured for driving the gate terminals of the first and second switching components Q4 and Q5 in accordance with the PWM signal PWM SIGNAL.

In the lamp system 200, the ballast 104 may be used to provide continuous dimming to a plurality of lamps 106A, 106B, and 106C. The lamps 106A, 106B, and 106C are connected together in parallel. A current limiting capacitor is connected in series with each of the lamps. Thus, a capacitor C9 is connected in series with lamp 106A, a capacitor C10 is connected in series with lamp 106B, and a capacitor C11 is connected in series with lamp 106C. The series connected capacitor C9 and lamp 106A, the series connected capacitor C10 and lamp 106B, and the series connected capacitor C11 and lamp 106C are connected together in parallel. The impedance device C20 is connected in series with each of the plurality of lamps 106A, 106B, and 106C. Thus, the impedance device C20 reduces the lamp current of each of the plurality of lamps 106A, 106B, and 106C when switching network is non-conductive.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A dimming ballast comprising:

a rectifier to receive an alternating current (AC) voltage signal and produce a rectified voltage signal therefrom;

a power factor correction circuit to receive the rectified voltage signal and to provide a corrected voltage signal;

an inverter circuit to receive the corrected voltage signal and to provide a lamp current to energize a lamp;

a dim interface to receive an input indicative of a selected lighting level;

a control circuit connected to the dim interface to generate a pulse-width-modulated signal having a duty cycle corresponding to the selected lighting level;

a switching network connected to the control circuit to receive the pulse-width-modulated signal, the switching network having a conductive state and a non-conductive state, wherein the switching network operates between the conductive state and the non-conductive state as a function of the pulse-width-modulated signal; and an impedance device connected across the switching network and configured to connect in series with the lamp so that the impedance device receives the lamp current when the switching network is operating in the non-conductive state and the lamp current bypasses the impedance device when the switching network is operating in the conductive state, resulting in the dimming of the lamp to the selected lighting level.

2. The dimming ballast of claim 1, wherein the dim interface is a continuous dim interface.

3. The dimming ballast of claim 1, wherein the pulse-width-modulated signal has a high state and a low state, wherein the switching network operates in the non-conductive state when the pulse-width-modulated signal is in the high state, and the switching network operates in the conductive state when the pulse-width-modulated signal is in the low state.

4. The dimming ballast of claim 1, wherein the pulse-width-modulated signal has a high state and a low state, wherein the switching network operates in the conductive state when the pulse-width-modulated signal is in the high state, and the switching network operates in the non-conductive state when the pulse-width-modulated signal is in the low state.

5. The dimming ballast of claim 1, wherein the switching network comprises:

a first metal-oxide-semiconductor field-effect transistor (MOSFET) having a gate terminal, a source terminal, and a drain terminal; and a second MOSFET having a gate terminal, a source terminal, and a drain terminal;

wherein the gate terminal of the first MOSFET is connected to a first terminal of the impedance device, and the gate terminal of the second MOSFET is connected to a second terminal of the impedance device.

6. The dimming ballast of claim 1, wherein the inverter circuit comprises a transformer, and wherein the inverter circuit is configured to provide the lamp current to the lamp via the transformer.

7. The dimming ballast of claim 6, wherein the dimming ballast comprises a transformer winding to provide power to the switching network, wherein the transformer winding is a bias winding on the transformer of the inverter circuit.

8. The dimming ballast of claim 1, wherein the dimming ballast is configured to energize a plurality of lamps that are connected together in parallel.

9. A dimming ballast comprising:

an inverter circuit to provide a lamp current to energize a lamp;

a dim interface to receive an input indicative of a selected lighting level;

a control circuit connected to the dim interface to generate a pulse-width-modulated signal having a duty cycle corresponding to the selected lighting level;

a switching network connected to the control circuit to receive the pulse-width-modulated signal, the switching network having a conductive state and a non-conductive state, wherein the switching network operates between the conductive state and the non-conductive state as a function of the pulse-width-modulated signal; and an impedance device connected across the switching network and configured to connect in series with the lamp so that the impedance device receives the lamp current when the switching network is operating in the non-conductive state and the lamp current bypasses the impedance device when the switching network is operating in the conductive state, resulting in the dimming of the lamp to the selected lighting level.

10. The dimming ballast of claim 9, further comprising:

a rectifier to receive an alternating current (AC) voltage signal and produce a rectified voltage signal therefrom; and a power factor correction circuit to receive the rectified voltage signal and to provide a corrected voltage signal, wherein the inverter is connected to the power factor correction circuit and the inverter is configured to generate the lamp current as a function of the corrected voltage signal.

11. The dimming ballast of claim 9, wherein the dim interface is a continuous dim interface.

12. The dimming ballast of claim 9, wherein the pulse-width-modulated signal has a high state and a low state, wherein the switching network operates in the non-conductive state when the pulse-width-modulated signal is in the high state, and the switching network operates in the conductive state when the pulse-width-modulated signal is in the low state.

13. The dimming ballast of claim 9, wherein the pulse-width-modulated signal has a high state and a low state, wherein the switching network operates in the conductive state when the pulse-width-modulated signal is in the high state, and the switching network operates in the non-conductive state when the pulse-width-modulated signal is in the low state.

14. The dimming ballast of claim 9, wherein the switching network comprises:

a first metal-oxide-semiconductor field-effect transistor (MOSFET) having a gate terminal, a source terminal, and a drain terminal; and a second MOSFET having a gate terminal, a source terminal, and a drain terminal;

wherein the gate terminal of the first MOSFET is connected to a first terminal of the impedance device and the gate terminal of the second MOSFET is connected to a second terminal of the impedance device.

15. The dimming ballast of claim 9, wherein the inverter circuit comprises a transformer, and the inverter circuit is configured to provide the lamp current to the lamp via the transformer.

16. The dimming ballast of claim 15, wherein the dimming ballast comprises a transformer winding to provide power to the switching network, wherein the transformer winding is a bias winding on the transformer of the inverter circuit.

17. The dimming ballast of claim 9, further comprising an isolation circuit connected between the control circuit and the switching network.

18. The dimming ballast of claim 9, wherein the dimming ballast is configured to energize a plurality of lamps that are connected together in parallel.

* * * * *